United States Patent [19]

Satomi et al.

[11] 4,183,653

[45] Jan. 15, 1980

[54] SHEET STRIPPER FOR AN ELECTROSTATOGRAPHIC APPARATUS

[75] Inventors: Toyokazu Satomi; Kunio Kudoh; Tetsuo Sakurai, all of Tokyo, Japan

[73] Assignee: Ricoh Company, Ltd., Tokyo, Japan

[21] Appl. No.: 924,839

[22] Filed: Jul. 14, 1978

[30] Foreign Application Priority Data

Jul. 21, 1977 [JP] Japan ..... 52-86700

[51] Int. Cl.[2] ..... G03G 15/00

[52] U.S. Cl. ..... 355/3 SH; 250/324; 271/DIG. 2; 355/3 CH

[58] Field of Search ..... 355/3 R, 3 CH, 3 TR, 355/3 SH, 14; 271/DIG. 2; 250/324, 325

[56] References Cited

U.S. PATENT DOCUMENTS 3,950,680 4/1976 Michaels et al. ..... 355/14 X 3,970,381 7/1976 Meagher et al. ..... 355/3 R 4,027,960 7/1977 Ladrigan ..... 355/3 TR

*Primary Examiner*—Fred L. Braun

*Attorney, Agent, or Firm*—David G. Alexander

[57] ABSTRACT

The surface of an electrostatic drum (12) is charged and radiated with a light image of an original document (16) to form an electrostatic image which is developed to form a toner image. A copy sheet (18) is moved into engagement with the drum (12) and an electrostatic charge applied thereto to transfer the toner image to the copy sheet (18). A corona discharge unit (27) applies an alternating voltage to the leading edge of the copy sheet (18) to discharge the same and cause the leading edge to separate from the drum (12). Thereafter, the discharge unit (27) applies an asymmetrical alternating voltage which partially discharges the remaining portion of the copy sheet (18) but does not cause the same to separate from the drum (12).

10 Claims, 6 Drawing Figures

SHEET STRIPPER FOR AN ELECTROSTATOGRAPHIC APPARATUS

BACKGROUND OF THE INVENTION

The present invention relates to an electrostatographic apparatus typified by an electrostatic copying machine.

Such a copying machine comprises an electrostatic drum which is rotated at constant speed, electrostatically charged and radiated with a light image of an original document to form an electrostatic image thereof. A toner substance is applied to the drum to develop the electrostatic image into a toner image. A copy sheet is moved into engagement with the drum and an electrostatic charge applied thereto to transfer the toner image to the copy sheet. The toner image is fixed to the copy sheet to provide a permanent reproduction of the original document.

Problems have remained heretofore unsolved regarding positively separating the copy sheet from the drum after toner image transfer while preventing the toner image from being degraded. A prior art attempt to overcome these problems involves applying an alternating corona discharge potential to the copy sheet to dissipate the effect of the transfer charge and remove the electrostatic attractive force between the copy sheet and the drum. Such an expedient is also desirable since dissipation of the electrostatic charge on the copy sheet prevents image degradation due to localized discharge if the copy sheet contacts metal parts of the copy machine after removal from the drum and before toner image fixing. However, application of alternating corona discharge tends to cause the copy sheet to separate from the drum during the transfer operation, especially where the transfer operation takes place at a lower portion of the drum, due to the weight of the copy sheet. This results in missing image areas in the copy.

In an attempt to overcome these difficulties it has been proposed to add a D.C. bias to the A.C. corona discharge. The bias voltage has a polarity which is the same as that of the toner substance for separating the leading edge of the copy sheet from the drum. Then, the polarity of the bias voltage is reversed to reduce the discharge effect on the copy sheet and prevent the remaining portion thereof from separating from the drum during the transfer step.

This expedient is not satisfactory either since a separate D.C. bias voltage source must be provided and the toner image at the leading edge portion of the copy sheet differs from the toner image on the remainder of the copy sheet.

SUMMARY OF THE INVENTION

In accordance with the present invention imaging means form an electrostatic image on a moving photoconductive member. Developing means develop the electrostatic image into a toner image and transfer means feed a copy medium into engagement with the photoconductive member and transfer the toner image thereto. The apparatus is characterized by comprising corona discharge means operatively disposed adjacent to the photoconductive member downstream of the transfer means in a direction of movement of the photoconductive member. A voltage source applies a first alternating voltage to the discharge means while a leading edge portion of the copy medium passes adjacent to the discharge means. The first alternating voltage is selected to at least partially discharge the leading edge portion and cause the leading edge portion to separate from the photoconductive member. The voltage source means applies a second asymmetrical alternating voltage to the discharge means after the leading edge portion of the copy medium passes the discharge means, the second asymmetrical alternating voltage being selected to partially discharge the copy medium but be insufficient to cause the copy medium to separate from the photoconductive member.

It is an object of the present invention to provide an electrostatographic apparatus comprising improved means for separating a copy sheet from a photoconductive drum or the like after toner image transfer thereto.

It is another object of the present invention to provide an electrostatographic apparatus comprising means for partially discharging a copy sheet after toner image transfer without causing the copy sheet to separate from a photoconductive drum during toner image transfer.

It is another object of the present invention to prevent toner image degradation during separation of a copy sheet from a photoconductive drum after toner image transfer thereto.

It is another object of the present invention to provide a generally improved electrostatographic apparatus.

Other objects, together with the foregoing, are attained in the embodiments described in the following description and illustrated in the accompanying drawing.

DESCRIPTION OF THE PREFERRED EMBODIMENTS

While the electrostatographic apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
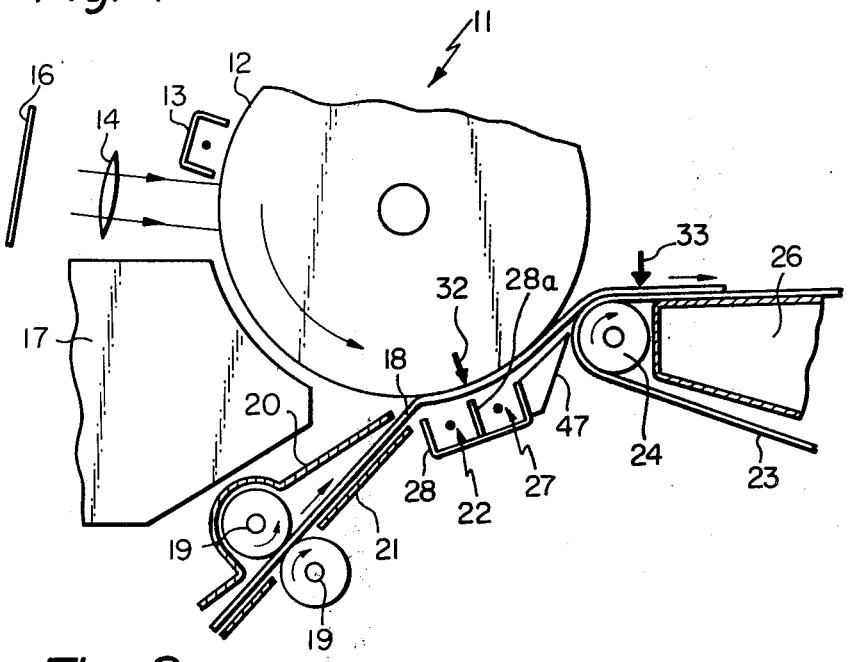
FIG. 1 is a schematic diagram of an electrostatographic apparatus embodying the present invention.

Referring now to FIG. 1 of the drawing, an electrostatographic apparatus embodying the present invention is illustrated as being in the form of an electrostatic copying machine which is generally designated by the reference numeral 11 and comprises a photoconductive drum 12 which is rotated counterclockwise at constant speed. A primary charger 13 such as a corona discharge unit applies a uniform electrostatic charge to the drum 12. In this example, it will be assumed that the charger 13 applies a positive charge to the drum 12.

Then, an imaging optical system here shown symbolically as a converging lens 14 focusses a light image of an original document 16 onto the drum 12 to form an electrostatic image through localized photoconduction. A developing unit 17 then applies a negatively charged, powdered toner substance to the drum 12 to develop the electrostatic image into a toner image. The negatively charged toner substance adheres to positively charged portions of the electrostatic image which correspond to dark image areas of the document 16.

A copy medium in the form of a paper sheet 18 is fed by feed rollers 19 between lower and upper guides 21 and 20 into engagement with the drum 12. The drive start of the feed rollers 19 is timed such that the leading edge of the copy sheet 18 aligns with the leading edge of the toner image on the drum 12.

A transfer charger 22 such as a corona discharge unit applies a positive charge to the back side of the copy sheet 18 which causes the copy sheet 18 to adhere to the drum 12 and further causes the toner image to be transferred from the drum 12 to the copy sheet 18.

A conveyor belt 23 is trained around a roller 24 and other rollers which are not shown and driven for clockwise rotation. After separation of the copy sheet 18 from the drum 12 after toner image transfer, the copy sheet 18 is carried by the conveyor belt 23 to a fixing unit (not shown) which fixes the toner image to the copy sheet 18 through heat and/or pressure. Further illustrated is a vacuum box 26 which applies a suction force through holes in the conveyor belt 23 to the copy sheet 18 to aid in removal of the copy sheet 18 from the drum 12 and to ensure transport of the copy sheet 18 to the fixing unit.

Figure 2:
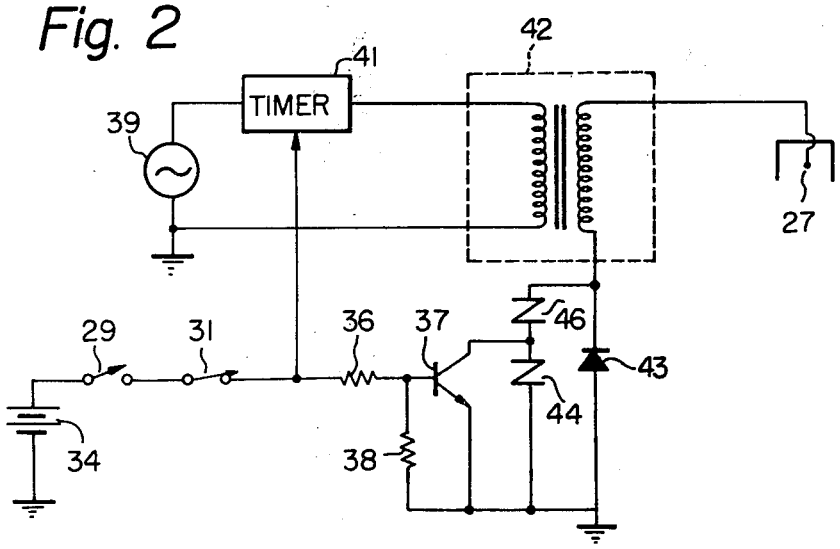
FIG. 2 is an electrical schematic diagram of part of the present apparatus.
Figure 4:
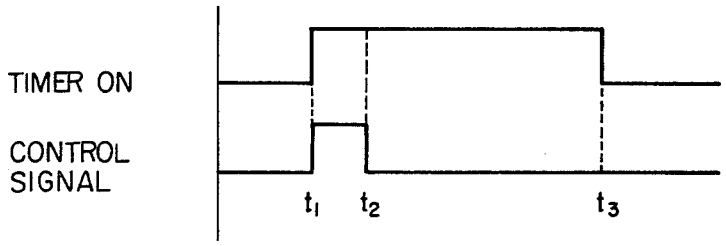
FIG. 4 is a timing diagram of the present apparatus.
Figure 5:
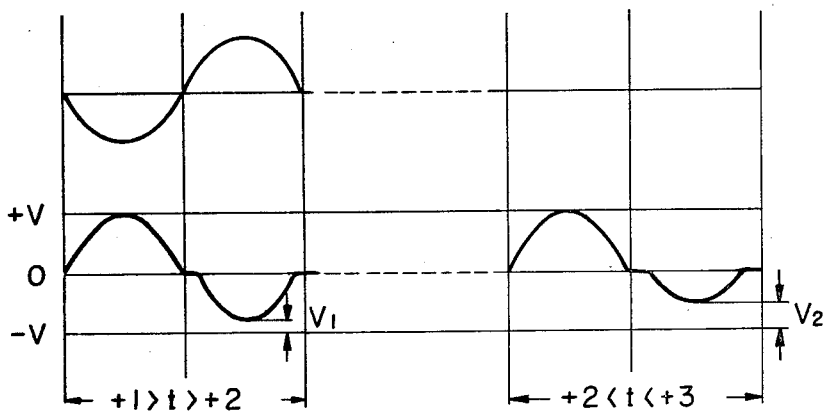
FIG. 5 is a waveform diagram illustrating the operation of the apparatus.

Further illustrated is a corona discharge unit 27 which is provided in a same shield casing 28 as the transfer charger 22 but separated from the transfer charger 22 by a partition 28*a*. With reference also being made to FIGS. 2, 4 and 5, it will be understood that a normally open microswitch 29 is provided at a position indicated by an arrow 32 and that a normally closed microswitch 31 is provided at a position indicated by an arrow 33. The microswitches 29 and 31 are arranged to be changed over through engagement of the copy sheet 18 therewith. The microswitch 29 is provided at the partition 28*a* and the microswitch 31 is provided at the left end of the vacuum box 26. It will be noted that the corona discharge unit 27 is provided downstream of the transfer charger 22 in the direction of movement of the copy sheet 18.

As best seen in FIG. 2 the negative terminal of a D.C. power source symbolized by a battery 34 is grounded. The positive terminal of the battery 34 is connected through the switches 29 and 31 in series and a resistor 36 to the base of an NPN transistor 37. The emitter of the transistor 37 is grounded. The base of the transistor 37 is also connected to ground through a resistor 38.

An A.C. voltage source 39 which produces a symmetrical alternating voltage is connected through a timer 41 to the primary winding of a step-up transformer 42. A lower end of the secondary winding of the transformer 42 is connected through a rectifying diode 43 to ground. An upper end of the secondary winding of the transformer 42 is connected to the corona discharge unit 27. The anode of the diode 43 is grounded.

First and second varistors 44 and 46 are connected in series across the diode 43. The collector of the transistor 37 is connected to the junction of the varistors 44 and 46.

In operation, the leading edge of the copy sheet 18 engages with and closes the microswitch 29. Since the microswitch 31 is normally closed, the positive terminal of the battery 34 is connected through the switches 29 and 31 and resistor 36 to the base of the transistor 37. This causes the transistor 37 to conduct and effectively short out the first varistor 44. With both switches 29 and 31 closed, the positive voltage applied therefrom to the transistor 37 as illustrated in FIG. 4 constitutes a control signal.

The control signal also triggers the timer 41 which connects the voltage source 39 to the transformer 42. The positive alternations of the alternating voltage induced in the secondary winding of the transformer 42 cause the diode 43 to conduct and effectively connect the lower end of the secondary winding of the transformer 42 to ground. Thus, during the positive alternations of the alternating voltage the transformer 42 functions in a conventional manner.

However, the diode 43 is reverse biased during the negative alternations of the induced voltage in the secondary winding of the transformer 42 and does not pass any current therethrough. Since the varistor 44 is shorted out by the transistor 37, which acts as a switch means, the lower end of the varistor 46 is connected to ground through the varistor 46.

The varistors 44 and 46 exhibit very high resistance when the voltage thereacross is below the varistor voltage thereof. However, as the applied voltage exceeds the varistor voltage, the varistors 44 and 46 exhibit low resistance.

Thus, during the negative alternations of the induced voltage in the secondary winding of the transformer 42 there will be no current flow until the voltage exceeds the varistor voltage of the varistor 46. Then, since the resistance of the varistor 46 decreases to a low value, current will flow through the secondary winding of the transformer 42 limited by the conduction resistance of the varistor 46.

Assuming that the switch 29 is closed at a time t1, FIG. 5 shows the waveform of the voltage applied to the corona discharge unit 27 between the time t1 and a time t2 at which the leading edge of the copy sheet 18 opens the microswitch 31. It will be seen that although the positive alternations of the voltage are unchanged, the magnitude of the negative alternations is reduced by a voltage V1 which corresponds to the conduction resistance of the varistor 46. In addition, during negative alternations there is no current flow when the voltage across the varistor 46 is below the varistor voltage thereof. The result is that a small, net positive charge is applied to the leading edge portion of the copy sheet 18.

However, the net positive charge is small and the leading edge portion of the copy sheet 18 is discharged so much that it separates from the drum 12 due to its own weight. The leading edge portion of the copy sheet 18 thus separated from the drum 12 is guided over a guide 47 onto the conveyor belt 23.

When the switch 31 is opened by the leading edge of the copy sheet 18 at the time t2 the transistor 37 is turned off. As a result the varistor 44 is effectively connected in series with the varistor 46. The varistor voltage of the varistors 44 and 46 in series is the sum of the individual varistor voltages thereof. Thus, during subsequent negative alternations of the voltage in the secondary winding of the transformer 42, there will be no current flow except during the central portions of the alternations when the applied voltage is above the varistor voltage of the varistors 44 and 46 in series. This is shown in FIG. 5 between the time t2 and a time t3 when the timer 41 times out. The time t3 is designed to correspond to the trailing edge of the copy sheet 18 reaching the position of the arrow 33.

With the short circuit removed from the varistor 44 the voltage during the negative alternations which is applied to the corona discharge unit 27 is reduced by a voltage V2 which is greater than V1. Thus, a first asymmetrical alternating voltage is applied to the unit 27 between the times t1 and t2 and a second asymmetrical alternating voltage is applied to the unit 27 between the times t2 and t3, with the second voltage being more asymmetrical than the first voltage. The first asymmetrical alternating voltage is designed to discharge the leading edge portion of the copy sheet 18 enough to cause the copy sheet 18 to separate from the drum 12. The net charge applied to the copy sheet 18 between the times t2 and t3 while the second asymmetrical alternating voltage is applied to the discharge unit 27 has a net positive value which is more positive than that of the first asymmetrical alternating voltage. The second asymmetrical alternating voltage is selected to be insufficient to cause the copy sheet 18 to separate from the drum 12 but as high as possible within this limiting value to partially discharge the copy sheet 18 and prevent degeneration of the toner image caused by localized discharge through engagement of the copy sheet 18 with metal parts of the copy machine 11. It will be noted that the voltage supply to the transformer 42 is terminated when the timer 41 times out.

Figure 3:
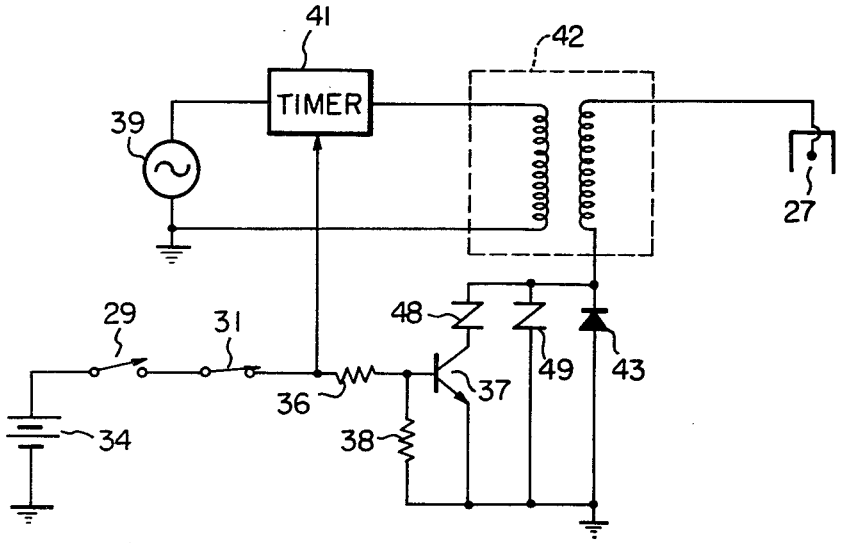
FIG. 3 is similar to FIG. 2 but shows a modified embodiment.

FIG. 3 shows a modified form of the invention in which like elements are designated by the same reference numerals. The varistors 44 and 46 are replaced by varistors 48 and 49 connected in parallel with each other and also in parallel with the diode 43. The transistor 37 is connected in series with the varistor 48. In this case, the varistor 49 is selected to have a relatively high varistor voltage such as 1 KV whereas the varistor 48 is selected to have a relatively low varistor voltage such as 180 V.

Between the times t1 and t2 which the control signal is high and the transistor 37 is turned on, the varistor 48 is effectively connected in parallel with the varistor 49. In this case the low varistor voltage of the varistor 48 is dominant and the negative alternations of the voltage applied to the discharge unit 27 are reduced by a relatively small amount. However, when the transistor 37 is turned off at the time t2, the varistor 48 is effectively removed from the circuit and the negative alternations are reduced by a relatively large amount by the varistor 49. The waveforms are essentially similar to those of the embodiment of FIG. 2.

Figure 6:
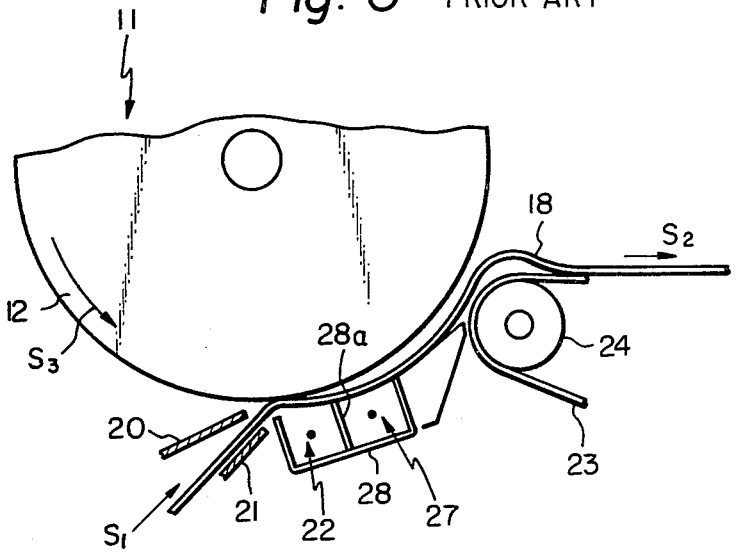
Fig. 6 PRIOR ART
FIG. 6 is a schematic diagram illustrating a malfunction which is overcome by the present invention.

FIG. 6 illustrates what happens in a prior art apparatus 11' in which a symmetrical alternating voltage is applied to a corona discharge unit 27' at all times. Like elements are designated by the same reference numerals used in the present apparatus 11.

Generally, the inlet feed speed of the copy sheet 18 is S1 and the outlet feed speed is S2. The copy sheet 18 moves at the same speed as the drum 12 when in contact therewith for toner image transfer, this speed being designated as S3. The speeds are selected to prevent tearing or pulling of the copy sheet 18 in such a manner that $S1 > S3 > S2$.

Application of a symmetrical alternating voltage to the copy sheet 18 will cause excessive reduction of the electrostatic attractive force between the copy sheet 18 and drum 12 in the toner image transfer region which will allow the copy sheet 18 to separate from the drum 12 due to its own weight. This will result in the formation of loops upstream and downstream of the transfer station which will cause further separation of the copy sheet 18 from the drum 12. With the copy sheet 18 separated from the drum 12 in the transfer region, the result will be a failure of toner image transfer and missing portions of the image.

In summary, it will be seen that the present invention ensures reliable separation of a copy sheet from a photoconductive drum while preventing the undesirable side effect of image degradation. Various modifications will become possible for those skilled in the art after receiving the teachings of the present disclosure. For example, the first alternating voltage may be a symmetrical alternating voltage. As another modification, the varistors 46 and 44 or the varistors 48 and 49 may be replaced by another variable resistance means comprising resistors, zener diodes, etc. The variators 46 and 44 may have different varistor voltages. Where zener diodes are used, they may have different zener voltages. If the diode 43 were reversed, it is clear that the positive alternations of the voltage applied to the corona discharge unit 27, rather than negative alternations would be reduced in magnitude. It will be clear to all those skilled in the art that the present invention is embodied without the increase in complexity and expense necessitated by the provision of a D.C. bias volage source for the corona discharge unit as is required in the prior art. In certain application the present invention allows elimination of the vacuum box 26.

What is claimed is:

1. An electrostatographic apparatus including a moving photoconductive member, imaging means for forming an electrostatic image on the photoconductive member, developing means for developing the electrostatic image into a toner image and transfer means for feeding a copy medium into engagement with the photoconductive member and transferring the toner image thereto, characterized by comprising:

corona discharge means operatively disposed adjacent to the photoconductive member downstream of the transfer means in a direction of movement of the photoconductive member; and voltage source means for applying a first alternating voltage to the discharge means while a leading edge portion of the copy medium passes adjacent to the discharge means, the first alternating voltage being selected to at least partially discharge the leading edge portion and cause the leading edge portion to separate from the photoconductive member;

the voltage source means applying a second asymmetrical alternating voltage to the discharge means after the leading edge portion of the copy medium passes the discharge means, the second asymmetrical alternating voltage being selected to partially discharge the copy medium but be insufficient to cause the copy medium to separate from the photoconductive member.

2. An electrostatographic apparatus including a moving photoconductive member, imaging means for forming an electrostatic image on the photoconductive member, developing means for developing the electrostatic image into a toner image and transfer means for feeding a copy medium into engagement with the photoconductive member and transferring the toner image thereto, characterized by comprising:

corona discharge means operatively disposed adjacent to the photoconductive member downstream of the transfer means in a direction of movement of the photoconductive member; and voltage source means for applying a first alternating voltage to the discharge means while a leading edge portion of the copy medium passes adjacent to the discharge means, the first alternating voltage being selected to at least partially discharge the leading edge portion and cause the leading edge portion to separate from the photoconductive member;

the voltage source means applying a second asymmetrical alternating voltage to the discharge means after the leading edge portion of the copy medium passes the discharge means, the second asymmetrical alternating voltage being selected to partially discharge the copy medium but be insufficient to cause the copy medium to separate from the photoconductive member, the voltage source means comprising first means for producing a symmetrical alternating voltage and second means for reducing a magnitude of positive alternations of the symmetrical alternating voltage.

3. An electrostatographic apparatus including a moving photoconductive member, imaging means for forming an electrostatic image on the photoconductive member, developing means for developing the electrostatic image into a toner image and transfer means for feeding a copy medium into engagement with the photoconductive member and transferring the toner image thereto, characterized by comprising:

corona discharge means operatively disposed adjacent to the photoconductive member downstream of the transfer means in a direction of movement of the photoconductive member; and voltage source means for applying a first alternating voltage to the discharge means while a leading edge portion of the copy medium passes adjacent to the discharge means, the first alternating voltage being selected to at least partially discharge the leading edge portion and cause the leading edge portion to separate from the photoconductive member;

the voltage source means applying a second asymmetrical alternating voltage to the discharge means after the leading edge portion of the copy medium passes the discharge means, the second asymmetrical alternating voltage being selected to partially discharge the copy medium but be insufficient to cause the copy medium to separate from the photoconductive member, the voltage source means comprising first means for producing a symmetrical alternating voltage and second means for reducing a magnitude of negative alternations of the symmetrical alternating voltage.

4. An apparatus as in claim 1, in which the voltage source means is constructed to produce the first alternating voltage as an asymmetrical alternating voltage which is less asymmetrical than the second alternating voltage.

5. An apparatus as in claim 2 or 3, in which the second means comprises a rectifying element, variable resistance means connected in parallel with the rectifying element and control means for controlling the resistance of the variable resistance means.

6. An apparatus as in claim 5, in which the variable resistance means comprises a varistor.

7. An apparatus as in claim 5, in which the variable resistance means comprises first and second varistors connected in series, the control means comprising switch means connected in parallel with the first varistor.

8. An apparatus as in claim 5, in which the variable resistance means comprises first and second varistors connected in parallel, the control means comprising switch means connected in series with the first varistor.

9. An apparatus as in claim 7, in which the first and second variators have different varistor voltages.

10. An apparatus as in claim 8, in which the first and second varistors have different varistor voltages.

* * * * *